US008011101B2

(12) United States Patent
Coffin et al.

(10) Patent No.: US 8,011,101 B2
(45) Date of Patent: Sep. 6, 2011

(54) REPLACEMENT CARTRIDGE FOR A RAZOR ASSEMBLY

(75) Inventors: David Coffin, Hamden, CT (US); Glennis Orloff, Woodbridge, CT (US); Mark Peyser, Easton, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 12/043,162

(22) Filed: Mar. 6, 2008

(65) Prior Publication Data

US 2008/0196250 A1 Aug. 21, 2008

Related U.S. Application Data

(60) Division of application No. 10/367,133, filed on Feb. 14, 2003, now Pat. No. 7,370,419, which is a continuation-in-part of application No. 09/505,408, filed on Feb. 16, 2006, now Pat. No. 6,584,690.

(60) Provisional application No. 60/375,843, filed on Apr. 24, 2002.

(51) Int. Cl.
*B26B 21/44* (2006.01)

(52) U.S. Cl. ..... 30/41; 30/50

(58) Field of Classification Search ..... 30/41, 41.5, 30/50, 535, 34.2, 538, 123.3
See application file for complete search history.

(56) References Cited

U.S. PATENT DOCUMENTS

| | | | | |
|---|---|---|---|---|
| 330,418 | A | | 11/1885 | Partridge et al. |
| 951,036 | A | | 3/1910 | Waterman |
| 1,342,028 | A | | 6/1920 | Nordskog |
| 1,543,387 | A | | 6/1925 | Kawalle |
| 1,744,280 | A | | 1/1930 | Peterson |
| 1,768,307 | A | | 6/1930 | Bleloch et al. |
| 1,836,800 | A | | 12/1931 | Hope |
| 2,183,554 | A | | 12/1939 | Evans |
| 2,586,626 | A | | 2/1952 | Dunn |
| 2,614,321 | A | | 10/1952 | Ackeman |
| 2,669,738 | A | | 2/1954 | Kusznir |
| 2,839,224 | A | | 6/1958 | Lipka |
| 2,857,908 | A | * | 10/1958 | Cornfield ..... 600/240 |
| 3,378,922 | A | | 4/1968 | Schrader et al. |
| 3,477,127 | A | | 11/1969 | Regan |
| 3,488,764 | A | | 1/1970 | Welsh |
| 3,675,323 | A | | 7/1972 | Braginetz |
| 3,702,026 | A | | 11/1972 | Scholin |
| 3,703,764 | A | | 11/1972 | Perry |
| 3,703,765 | A | | 11/1972 | Perez |
| 3,724,070 | A | | 4/1973 | Dorion, Jr. |
| 3,786,563 | A | | 1/1974 | Dorion, Jr. et al. |
| 3,832,774 | A | | 9/1974 | Perry |

(Continued)

FOREIGN PATENT DOCUMENTS

| | | |
|---|---|---|
| BE | 509715 | 3/1952 |

(Continued)

*Primary Examiner* — Kenneth E. Peterson

(74) *Attorney, Agent, or Firm* — Energizer Personal Care, LLC.

(57) ABSTRACT

A replacement cartridge for a razor assembly is provided that includes a shaving aid body for use with the razor assembly. The shaving aid body includes an aperture disposed within a contact surface. The aperture is sized to receive a razor cartridge. Some embodiments of the present replacement cartridge include a base. In some of those embodiments the base includes one or more features for attaching the replacement cartridge to the razor assembly.

9 Claims, 4 Drawing Sheets

U.S. PATENT DOCUMENTS

| | | | | |
|---|---|---|---|---|
| 3,871,077 | A | | 3/1975 | Nissen et al. |
| 3,895,437 | A | | 7/1975 | DiBuono |
| 3,934,338 | A | | 1/1976 | Braginetz |
| 3,935,639 | A | | 2/1976 | Terry et al. |
| 3,969,817 | A | | 7/1976 | DiBuono |
| 4,034,851 | A | | 7/1977 | Barksdale |
| 4,050,825 | A | | 9/1977 | Stein |
| 4,074,429 | A | | 2/1978 | Roberts |
| 4,170,821 | A | | 10/1979 | Booth |
| 4,241,500 | A | | 12/1980 | Iten |
| 4,309,014 | A | | 1/1982 | Blaszkowski |
| 4,314,404 | A | | 2/1982 | Ruiz et al. |
| 4,336,651 | A | | 6/1982 | Caro |
| 4,389,773 | A | | 6/1983 | Nissen et al. |
| 4,407,067 | A | | 10/1983 | Trotta |
| 4,442,598 | A | | 4/1984 | Jacobson |
| 4,443,940 | A | | 4/1984 | Francis et al. |
| 4,483,068 | A | | 11/1984 | Clifford |
| 4,518,553 | A | * | 5/1985 | Yarossi et al. ..... 264/234 |
| 4,534,110 | A | | 8/1985 | Glass |
| 4,535,537 | A | | 8/1985 | Ferraro et al. |
| 4,562,644 | A | | 1/1986 | Hitchens |
| 4,573,266 | A | | 3/1986 | Jacobson |
| 4,586,255 | A | | 5/1986 | Jacobson |
| 4,587,729 | A | | 5/1986 | Jacobson |
| 4,595,124 | A | | 6/1986 | Duval et al. |
| 4,621,424 | A | | 11/1986 | Jacobson |
| 4,621,934 | A | | 11/1986 | Starek |
| 4,624,051 | A | | 11/1986 | Apprille, Jr. et al. |
| 4,712,300 | A | | 12/1987 | Hemmeter |
| D298,068 | S | | 10/1988 | Gilder |
| 4,778,640 | A | | 10/1988 | Braun et al. |
| 4,807,360 | A | | 2/1989 | Cerier et al. |
| 4,850,106 | A | | 7/1989 | Braun et al. |
| 4,875,288 | A | | 10/1989 | Trotta et al. |
| 4,893,641 | A | | 1/1990 | Strickland |
| 4,901,437 | A | | 2/1990 | Iten |
| 4,944,090 | A | | 7/1990 | Sumnall |
| 4,950,094 | A | * | 8/1990 | Yorks ..... 401/75 |
| 4,964,214 | A | | 10/1990 | Welsh et al. |
| 4,970,784 | A | | 11/1990 | Althaus et al. |
| 4,977,670 | A | | 12/1990 | Iten |
| 4,979,298 | A | | 12/1990 | Pesiri |
| 4,984,365 | A | | 1/1991 | Leonard et al. |
| 5,005,287 | A | | 4/1991 | Ritter |
| 5,031,318 | A | | 7/1991 | Brown et al. |
| 5,036,587 | A | | 8/1991 | Trotta et al. |
| 5,056,222 | A | | 10/1991 | Miller et al. |
| 5,063,667 | A | | 11/1991 | Jacobson |
| 5,063,669 | A | | 11/1991 | Althaus |
| 5,079,839 | A | | 1/1992 | Conrad, Jr. et al. |
| 5,084,968 | A | | 2/1992 | Trotta |
| 5,085,634 | A | * | 2/1992 | Lackney ..... 604/77 |
| 5,121,541 | A | | 6/1992 | Patrakis |
| 5,134,775 | A | | 8/1992 | Althaus et al. |
| 5,141,349 | A | | 8/1992 | Maguire, Jr. et al. |
| 5,161,307 | A | | 11/1992 | Althaus |
| 5,191,712 | A | | 3/1993 | Crook et al. |
| 5,249,361 | A | | 10/1993 | Apprille, Jr. et al. |
| 5,265,759 | A | | 11/1993 | Coffin |
| 5,313,706 | A | | 5/1994 | Motta et al. |
| 5,319,852 | A | | 6/1994 | Metzger |
| 5,347,714 | A | | 9/1994 | Prochaska |
| 5,369,885 | A | | 12/1994 | Ferraro |
| 5,384,961 | A | | 1/1995 | Gregory |
| 5,430,939 | A | | 7/1995 | Johnston |
| 5,461,782 | A | | 10/1995 | Rauch |
| 5,463,813 | A | | 11/1995 | Otsuka et al. |
| 5,490,329 | A | | 2/1996 | Chylinski et al. |
| 5,493,778 | A | | 2/1996 | Ichivanaoi |
| 5,497,550 | A | | 3/1996 | Trotta et al. |
| 5,517,760 | A | | 5/1996 | Prochaska |
| D373,218 | S | | 8/1996 | Shurtleff et al. |
| 5,579,580 | A | | 12/1996 | Althaus et al. |
| 5,604,983 | A | | 2/1997 | Simms et al. |
| 5,626,154 | A | | 5/1997 | Rogers et al. |
| 5,666,729 | A | | 9/1997 | Ferraro |
| 5,711,076 | A | | 1/1998 | Yin et al. |
| D403,811 | S | | 1/1999 | Brown et al. |
| 5,953,825 | A | | 9/1999 | Christman et al. |
| 5,956,849 | A | | 9/1999 | Chadwick et al. |
| D415,315 | S | | 10/1999 | Swanson et al. |
| D416,108 | S | | 11/1999 | Shurtleff et al. |
| 6,161,287 | A | | 12/2000 | Swanson et al. |
| 6,185,823 | B1 | | 2/2001 | Brown et al. |
| 6,295,734 | B1 | | 10/2001 | Gilder et al. |
| 6,298,557 | B1 | | 10/2001 | Gilder et al. |
| 6,298,558 | B1 | | 10/2001 | Tseng et al. |
| 6,308,416 | B1 | | 10/2001 | Bosy et al. |
| 6,502,318 | B1 | | 1/2003 | Gilder |
| 6,584,690 | B2 | | 7/2003 | Orloff et al. |

FOREIGN PATENT DOCUMENTS

| | | | |
|---|---|---|---|
| DE | 319832 | | 2/1919 |
| DE | 8717729.3 | | 9/1989 |
| EP | 0276066 | | 1/1988 |
| EP | 0477132 | B1 | 3/1992 |
| EP | 0453906 | B1 | 11/1992 |
| EP | 1125697 | A1 | 8/2001 |
| FR | 482302 | | 3/1917 |
| FR | 806899 | | 12/1936 |
| FR | 1484360 | | 6/1967 |
| FR | 1503887 | | 12/1967 |
| GB | 409902 | | 5/1934 |
| GB | 1432182 | | 4/1976 |
| GB | 1572442 | | 7/1980 |
| GB | 2042959 | A | 10/1980 |
| GB | 2116470 | | 9/1983 |
| JP | 4361783 | | 12/1992 |
| WO | 9101204 | | 2/1991 |
| WO | 9411163 | | 5/1994 |
| WO | 9602369 | | 2/1996 |
| WO | 9836878 | | 8/1998 |

* cited by examiner

REPLACEMENT CARTRIDGE FOR A RAZOR ASSEMBLY

CROSS REFERENCE TO RELATED APPLICATIONS

This application is a division of U.S. patent application Ser. No. 10/367,133, filed on Feb. 14, 2003, now U.S. Pat. No. 7,370,419 incorporated herein by reference in its entirety, which claims benefit of U.S. Provisional Patent Application Ser. No. 60/375,843, filed on Apr. 24, 2002. U.S. patent application Ser. No. 10/367,133 is a continuation-in-part of U.S. patent application Ser. No. 09/505,408, filed on Feb. 16, 2000 now U.S. Pat. No. 6,584,690.

BACKGROUND OF THE INVENTION

This invention relates generally to shaving devices, and more specifically to replacement cartridges for razor assemblies.

Modern safety razors typically include a disposable razor cartridge and a reusable handle, or a handle and cartridge combined into a unitary disposable. Most razor cartridges include a frame, one or more razor blades, and a strip of shaving aid material attached to the frame. A strip of shaving aid material typically includes one or more shaving aids (e.g., lubricating agents, drag reducing agents, depilatory agents, cleaning agents, medicinal agents, etc.) that enhance the shaving process.

The comfort and performance provided by a particular safety razor (or "razor assembly") are critical to the commercial success of the razor assembly. Improvements that benefit razor comfort, performance, and ease of use, however significant or subtle, can have a decided impact on the commercial success of a razor assembly. For example, many consumers find it desirable to shave within a wet shaving environment. Unfortunately, the water within the wet shaving environment typically removes the shaving aid before the surface can be shaved. As a result, the function performed by the shaving aid goes unexecuted. What is needed, therefore, is a device that is capable of dispensing a shaving aid material in a wet shaving environment.

SUMMARY OF THE INVENTION

It is, therefore, an object of the present invention to provide a device that is capable of dispensing a shaving aid material in a wet shaving environment, and one that, if desired, can be utilized as a replacement cartridge.

According to the present invention, a replacement cartridge for a razor assembly is provided that includes a shaving aid body that includes a contact surface and an aperture disposed in the contact surface that is sized to receive a razor cartridge. In some embodiments, the shaving aid body is coupled to a base that includes one or more features for attaching the replacement cartridge to the razor assembly.

The present invention replacement cartridge provides considerable utility when used with a razor assembly that allows the position of one or both of the blades in the razor cartridge and the contact surface of the shaving aid body to be adjusted relative to the other. Examples of such razor assemblies are disclosed in U.S. patent application Ser. No. 09/505,408 filed Feb. 16, 2000; No. 60/405,185 filed Aug. 21, 2002, and U.S. patent application Ser. No. 10/367,255, filed Feb. 14, 2003, all of which are commonly assigned herewith and are hereby incorporated in their entirety by reference. The present replacement cartridge is not limited to such applications, however.

An advantage of the present invention replacement cartridge is that a device is provided that is capable of dispensing a shaving aid material in a wet shaving environment. In fact, a wet shaving environment can facilitate rather than impede the deposition of material from the shaving aid body of the present cartridge. Consequently, shaving within a wet shaving environment is not only possible, but practical as well.

Other advantages provided by the present replacement cartridge stem from the shaving aid body being a solid material that erodes during use, and distributes shaving aid material in the process. An absorbent applicator that must be filled with liquid shaving aid material prior to use, as is known in the prior art, requires additional effort by the user. It also requires that the user utilize an appropriate liquid. An inappropriate liquid accidentally loaded into the absorbent applicator could have undesirable results. An absorbent applicator in a wet shaving environment also absorbs water, and thereby likely dilutes and/or otherwise negatively effects the application of the liquid shaving aid material loaded into the applicator. Finally, an absorbent applicator consisting of a porous absorbent material will likely have an undesirable high running friction coefficient that produces unwanted drag. The present invention solid shaving aid body, in contrast, does not need to be filled before each use, provides an assurance regarding the shaving aid material, performs well in a wet shaving environment, and provides a desirable slippery surface, all of which increase the user's shave comfort.

In addition to the above-described advantages, the present invention replacement cartridge provides considerable utility when used with a razor assembly that allows the position of one or both of the blades in the razor cartridge and the contact surface of the shaving aid body to be adjusted relative to the other. During use, the contact surface of the solid shaving aid body provides a surface that can be located relative to the blades in the razor cartridge. The contact surface of the solid shaving aid body also provides a guide for the surface being shaved.

These and other objects, features, and advantages of the present invention will become apparent in light of the detailed description of the present invention.

DETAILED DESCRIPTION OF THE INVENTION

Figure 1:
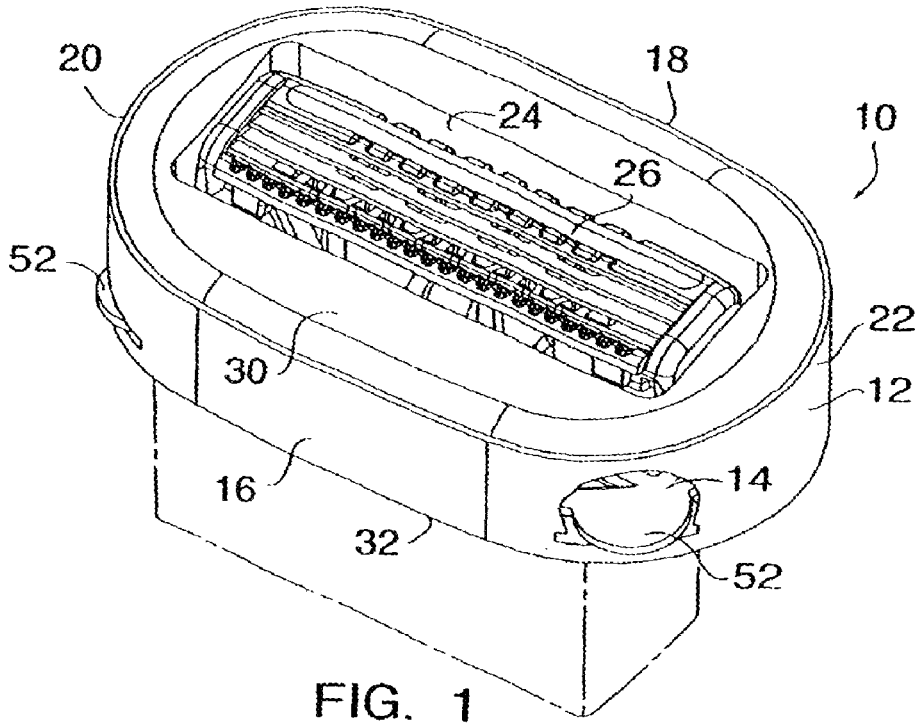
FIG. 1 is a perspective view of a replacement cartridge including a present invention shaving aid cartridge.
Figure 2:
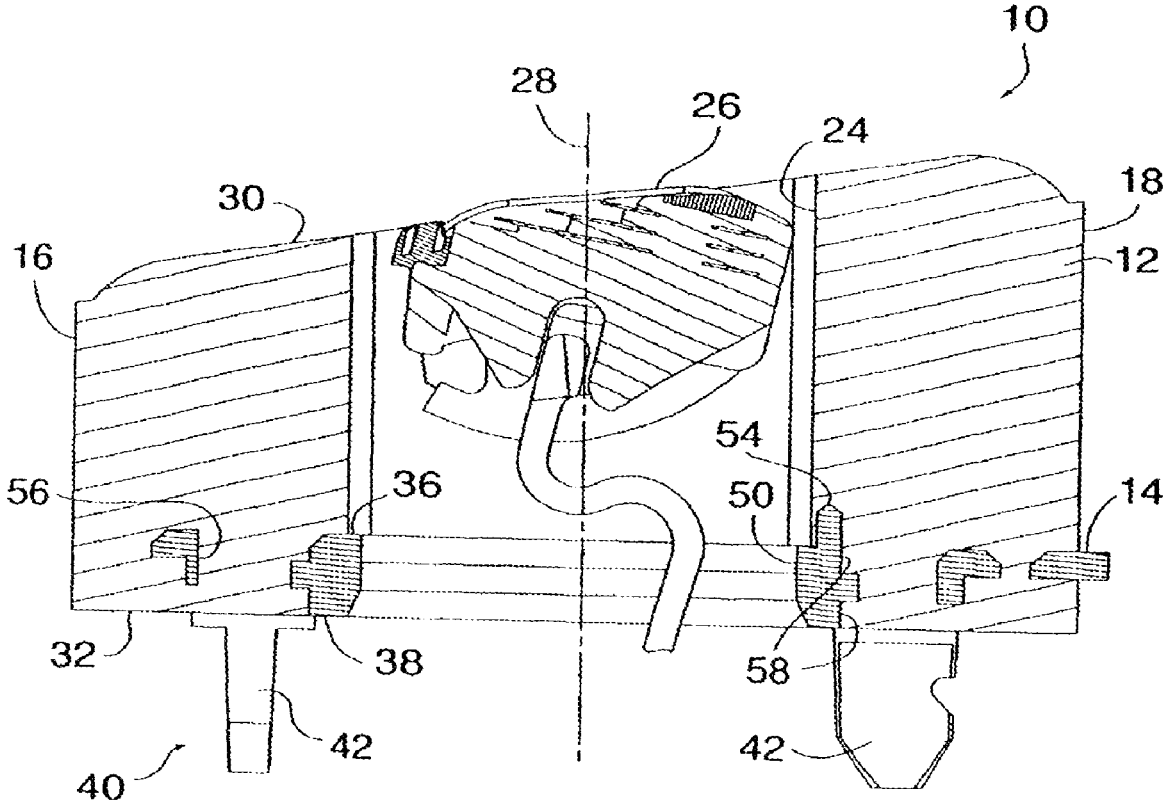
FIG. 2 is a diagrammatic cross-sectional view of a shaving aid cartridge showing the base embedded within the shaving aid body.
Figure 3:
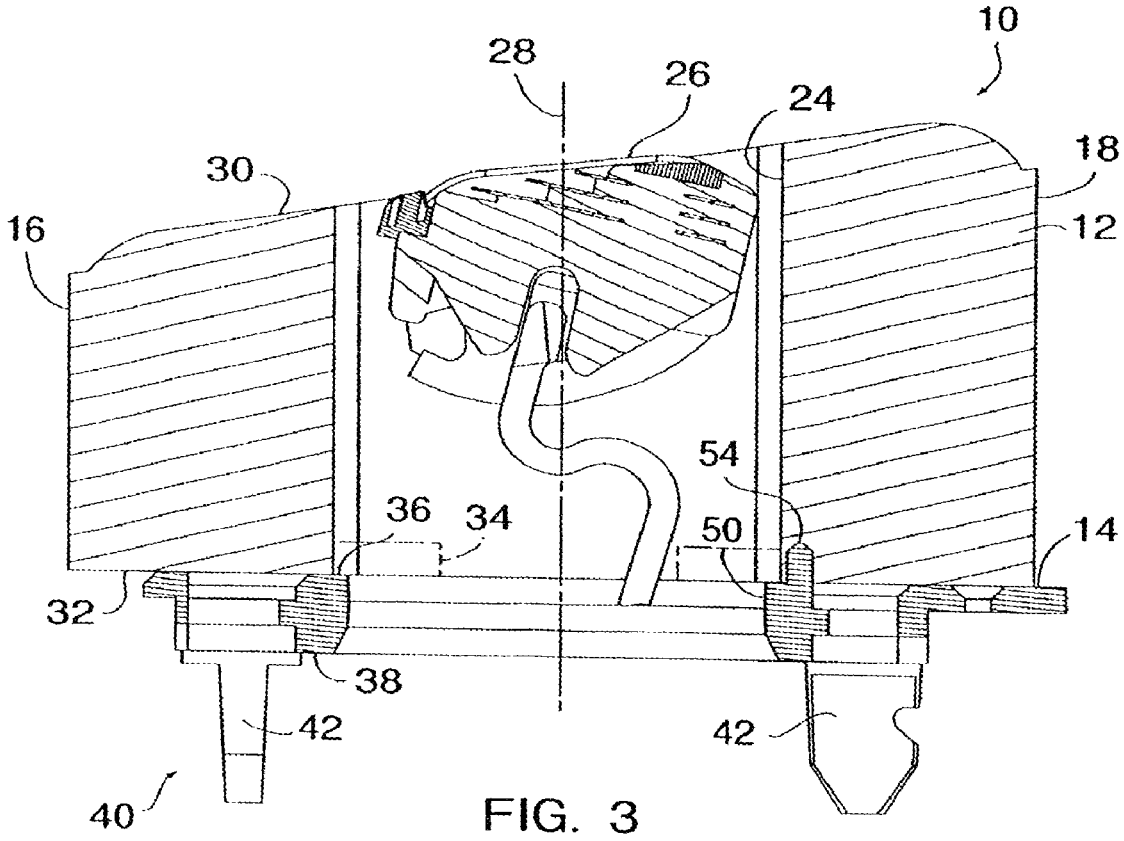
FIG. 3 is a diagrammatic cross-sectional view of a shaving aid cartridge showing the base attached to a surface of the shaving aid body.
Figure 4:
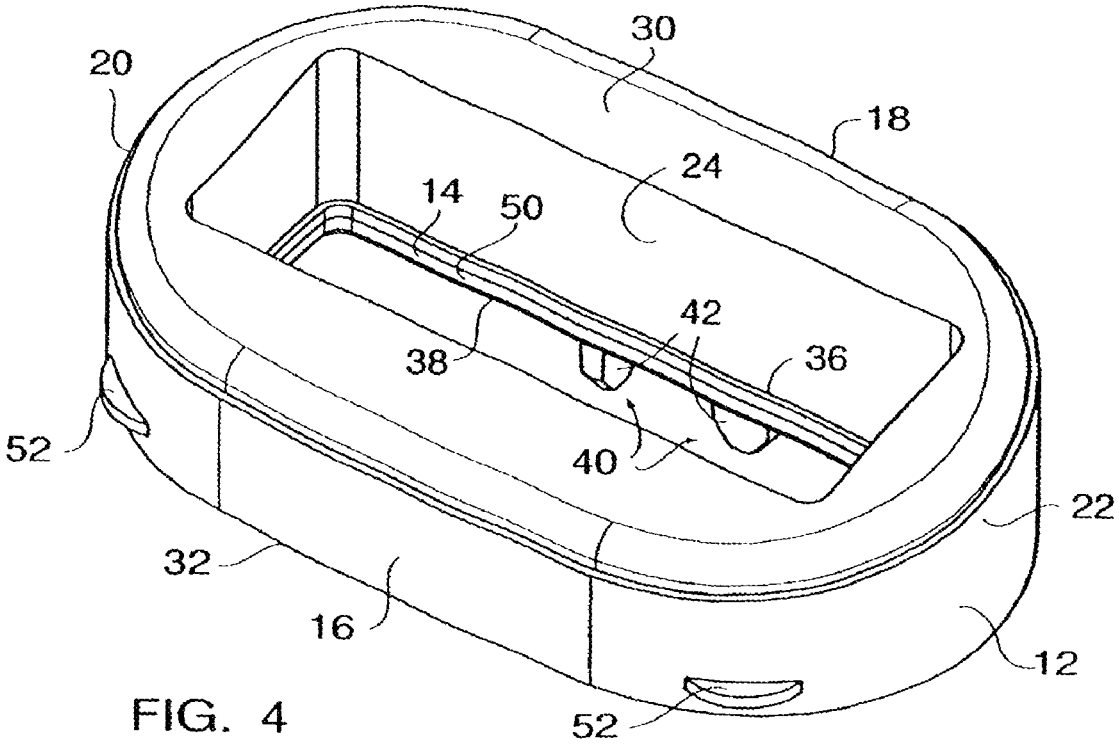
FIG. 4 is a perspective view of the shaving aid cartridge of FIG. 1 with the razor cartridge removed.
Figure 5:
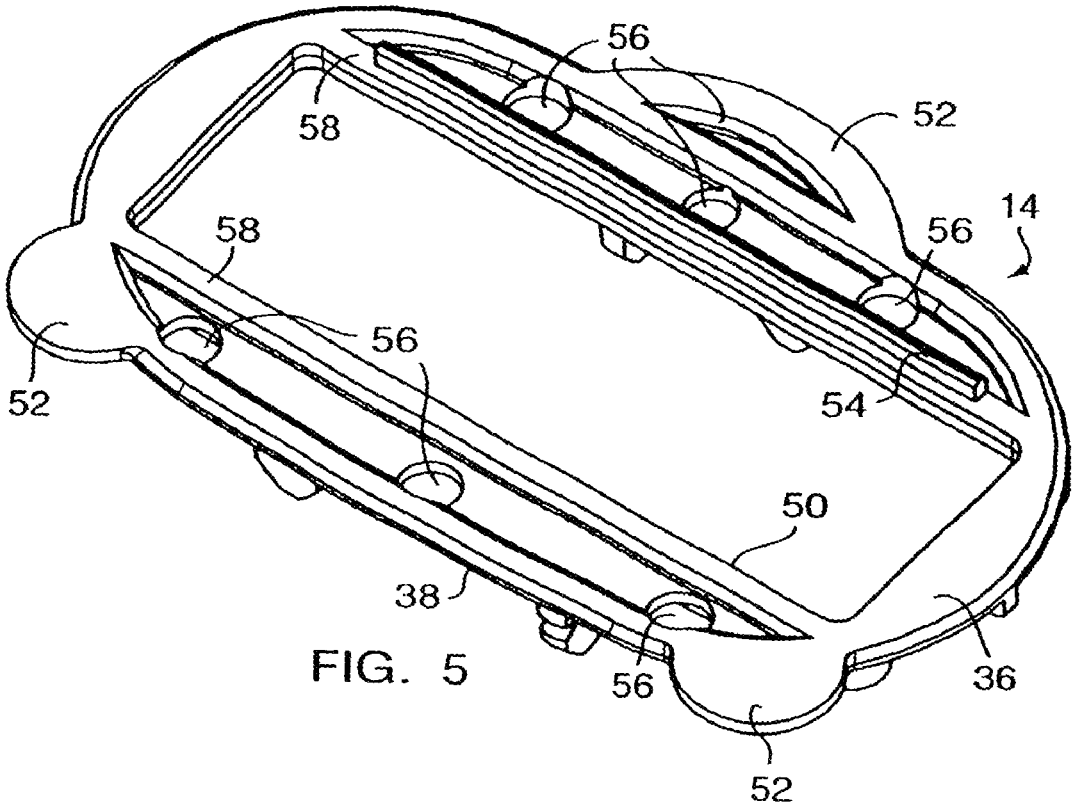
FIG. 5 is a top perspective view of a base embodiment.

Referring to FIGS. 1-4, a replacement cartridge 10 for use with a razor assembly (not shown) includes a shaving aid body 12. In the embodiment shown in FIGS. 1-4, the shaving aid body 12 is coupled to a base 14. The shaving aid body 12 has a forward portion 16, an aft portion 18, a first lateral portion 20, a second lateral portion 22, all of which are disposed around a centrally located aperture 24, which is sized to receive a razor cartridge 26. The aperture 24 may be described as having a centerline 28 (see FIGS. 2 and 3). The shaving aid body portions 16,18,20,22 extend from a contact surface 30 to a base surface 32. The aperture 24 is disposed in the contact surface 30. The aperture 24 may alternatively be described as being formed by a plurality of the shaving aid portions 16,18, 20,22 positioned relative to one another in a manner that creates the centrally located aperture 24. In some embodiments, the shaving aid body 12 is one piece, having a generally oval shape. In alternative embodiments, the shaving aid body 12 may assume an alternative shape and/or may include multiple pieces; e.g., the above-described portions of the shaving aid body 12 may be separate from one another. In addition, the shaving aid body 12 may be some combination of less than all of the portions. For example, in some applications it may be desirable to have a shaving aid body 12 that includes only a pair of lateral portions 20,22 and a forward portion 22. In other applications it may be desirable to have only a single forward portion 22. The exact configuration can be varied to suit the application. In the embodiments shown in FIGS. 2-4, the aperture 24 extends between the contact surface 30 and the base surface 32. In alternative embodiments, however, the aperture 24 may not extend between the surfaces 30,32. In such instances, a second aperture 34 (example shown in phantom in FIG. 3) may be included, extending between the base surface 32 and the aperture 24. The second aperture 34 may have a different cross-sectional geometry than the aperture 24, or the same. If the second aperture 34 has the same cross-sectional geometry as the aperture 24, the aperture 24 may be described as extending between the contact surface 30 and the base surface 32.

In some embodiments, the contact surface 30 is skewed at a non-perpendicular angle relative to the aperture centerline 28. The skew angle facilitates recognition by the user of the direction the razor assembly is intended to be stroked. The magnitude of the skew angle is application dependent based upon the relationship of the contact surface 30 of the shaving aid body 12 and the position of the razor cartridge 26.

The shaving aid body 12 is an erodable solid body consisting of a shaving aid material that is selected to suit the application at hand. A soap-type shaving aid material is particularly well suited for wet shaving applications, but other shaving aid materials (e.g., lubricating agents, drag reducing agents, depilatory agents, cleaning agents, medicinal agents, sensory agents, skin stimulation agents, etc.) can be used alternatively, or some combination thereof.

In those embodiments where the replacement cartridge 10 includes only a shaving aid body 12, the base surface 32 of the shaving aid body 12 may include features (e.g., apertures) to facilitate the attachment of the shaving aid body 12 to the razor assembly.

Figure 6:
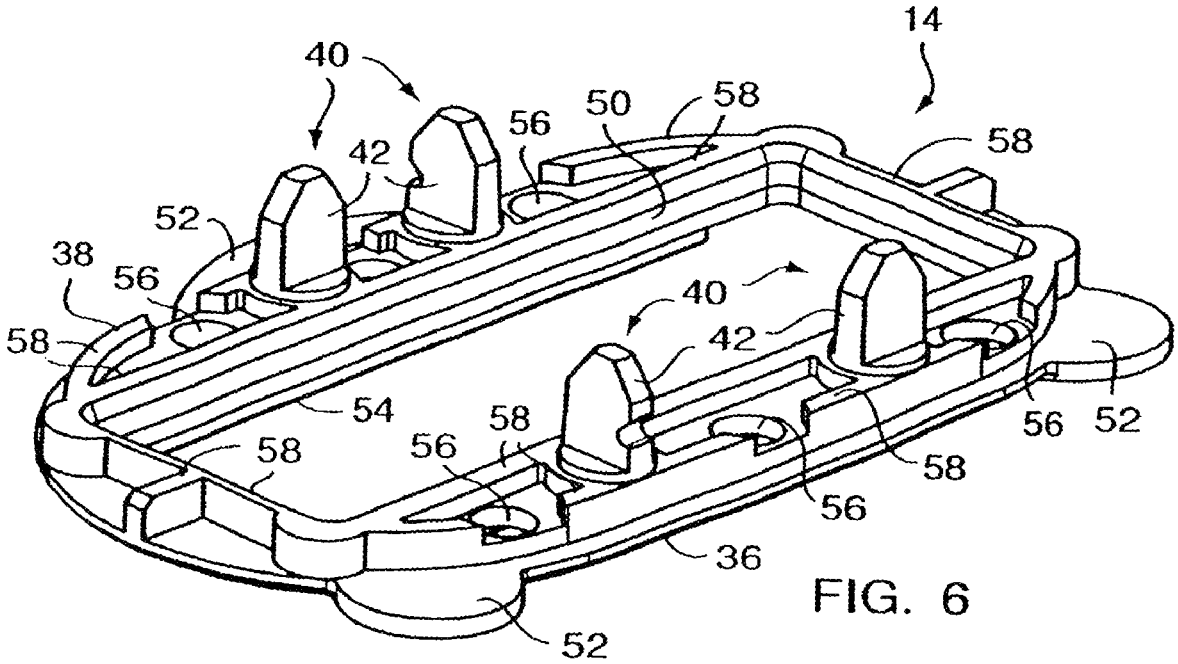
FIG. 6 is a bottom perspective view of a base embodiment.
Figure 7:
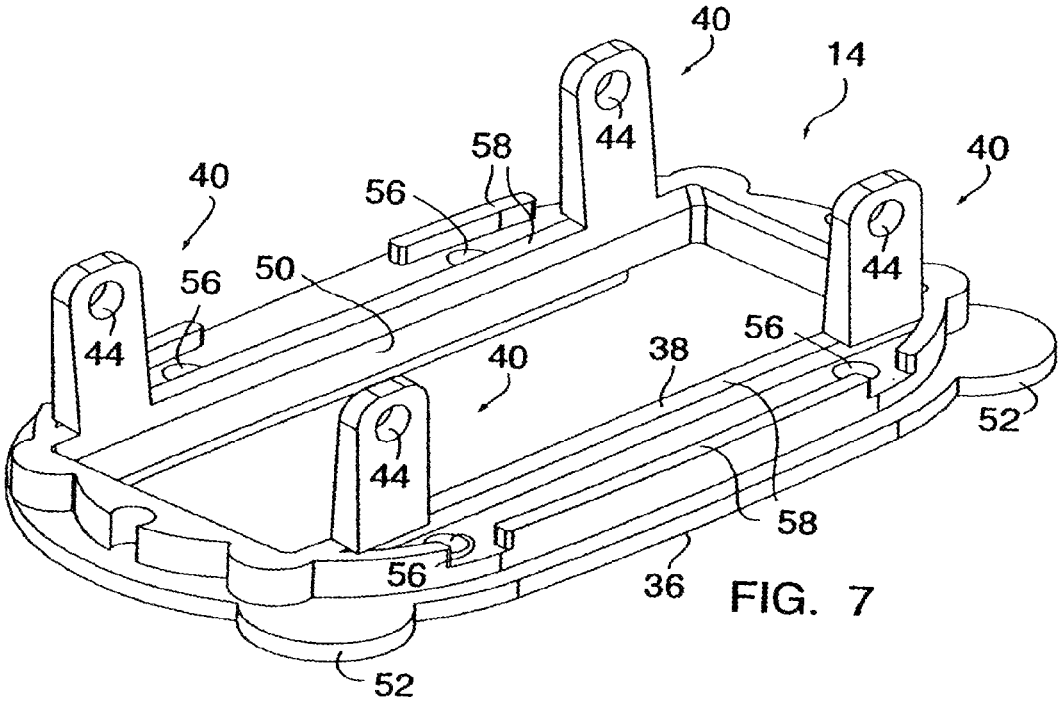
FIG. 7 is a bottom perspective view of a second base embodiment.
Figure 8:
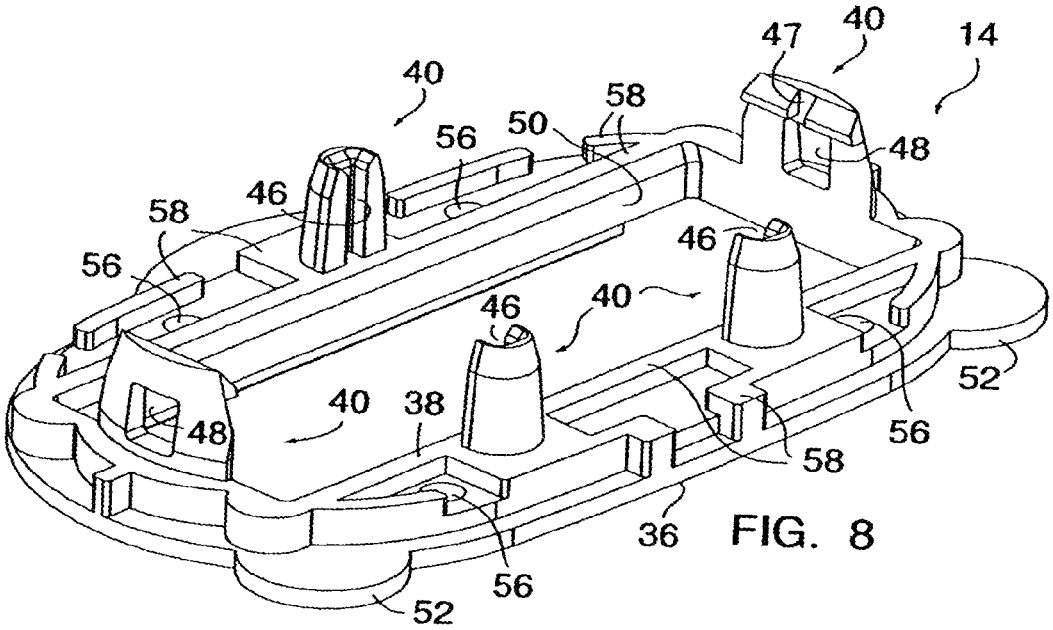
FIG. 8 is a bottom perspective view of a third base embodiment.

Now referring to FIGS. 5-8, the base 14 includes a first surface 36, a second surface 38, and one or more features 40 for attaching the replacement cartridge 10 to the razor assembly. The features 40 are preferably mechanical-type features such as tabs that extend outwardly from the second surface 38. A variety of different feature 40 configurations can be used. FIG. 6, for example, shows a plurality of notched tabs 42 extending out from the second surface 38. FIG. 7 shows a plurality of apertured tabs 44 extending out from the second surface 38. FIG. 8 shows an embodiment having two different features 40, one type of feature being a slotted tab 46 and the other type of feature being a combination of the slotted tab 46 and the apertured tab 44 of FIG. 7. In the embodiment of FIG. 8, the feature 40 that is a slotted/apertured combination includes an aperture 48 and a slot 47. The exact configuration of features 40 is selected to cooperate with the counterpart attachment mechanism of the razor assembly. Hence, the features 40 shown in FIGS. 5-8 are illustrative of the variety of mechanical features possible, but the present invention is not limited to these examples. In some embodiments, the features 40 are asymmetrically positioned on the base 14 in such a way as to provide a single orientation for proper installation of the replacement cartridge 10 on the razor assembly.

Figure 9:
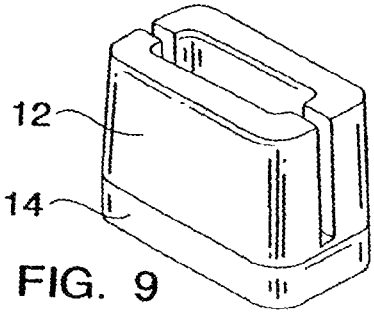
FIG. 9 is a perspective view of an embodiment of the present shaving aid cartridge.

In some embodiments, the base 14 further includes an aperture 50 that extends between the first surface 36 and second surface 38. The aperture 50 permits one or more elements (not shown) to extend between a razor cartridge disposed within the aperture 24 of the shaving aid body 12 and a mechanism attached to the razor assembly. U.S. patent application Ser. No. 09/505,408, incorporated by reference into the present application above, disclose examples of such razor assemblies. In the embodiments shown in FIGS. 2-4, the aperture 50 is aligned with and has an axial cross-section similar to, or the same as, the aperture 24 within the shaving aid body 12. In this configuration, the razor cartridge 26 can be received within the aperture 50 of the base 14. The embodiment shown in FIG. 9, in contrast, includes a base 14 without an aperture 50 coupled with a two piece shaving aid body 12. In those embodiments that include an aperture 50, the base may include features for guiding an element within the aperture 50. Referring to FIG. 8 for example, the features 40 include slots 46 for cooperation with guide surfaces attached to an element (not shown) that is received within the aperture to guide the element within the aperture 50. Other guide arrangements may be used alternatively.

Some embodiments of the base 14 further include a plurality of tabs 52 that extend out from the base 14 in a lateral direction. The tabs 52 are used to locate the replacement cartridge 10 within packaging. Some embodiments of the base also include a rail 54 (see FIG. 5) attached to the first surface 36 of the base 14. The rail 54 facilitates high speed feeding of the base 14 through automated forming and assembly equipment and thereby aids the manufacturing process. Other features that facilitate manufacturing and/or handling of the replacement cartridge 10 may be included alternatively, or in combination therewith.

In one embodiment of the present invention, the base 14 is integrally formed with the shaving aid body 12. The term "integrally formed" as used herein refers to a base 14 that consists of one or more shaving aid materials or constituents thereof and is at least partially formed at the same time as the shaving aid body 12. The portion of the shaving aid material that forms the base 14 either initially has, or is processed to have, sufficient mechanical strength to be operable to enable attachment of the replacement cartridge 10 to the razor assembly. The appropriate process (e.g., curing, compression, etc.) used to produce sufficient mechanical strength within the integral base 14 will depend on the shaving aid material.

In some embodiments of the present invention, the base 14 is a separate member that is partially or completely embedded within the shaving aid body 12 when the shaving aid body 12 is formed. Mechanical features other than those used to directly or indirectly attach the replacement cartridge 10 to the razor assembly (i.e., features 40), are used to secure the shaving aid body 12 and base 14 together. For example, the apertures 56 disposed in, and the flanges 58 attached to, the base 14 create passages and voids in which a shaving aid material in liquid form can travel and solidify during formation. Once solidified, the mechanical strength of the shaving aid material (aided by the geometry created within the aforesaid passages and voids) is sufficient to keep the shaving aid body 12 and the embedded base 14 together.

In alternative embodiments, the base 14 is attached to, rather than being embedded in, the shaving aid body 12. The attachment can be accomplished by a variety of methods, including but not limited to mechanical means (e.g., screws, rivets, pins, barbs, etc.), adhesive (e.g., glue, etc.), or bonding (e.g., welding, etc.).

Although the present invention has been described in considerable detail with reference to certain preferred versions thereof, other versions are possible. Therefore, the spirit and scope of the invention should not be limited to the description of the preferred versions contained herein.

What is claimed is:

1. A shaving aid cartridge for a razor assembly, comprising:

a solid erodable body of a shaving aid material consisting essentially of a soap-type material, wherein the body includes a base surface and a contact surface; a first aperture disposed in the contact surface and extending between the base surface and the contact surface, wherein the first aperture defines a centerline and is sized to encircle a razor cartridge of the razor assembly; and a base partially or completely embedded in the erodable body adjacent the base surface;

wherein the base includes a first surface and a second aperture sized to receive the razor cartridge; and wherein the base further includes one or more projections attached to the base and disposed on opposed sides of the second aperture having shaving aid material solidification apertures extending in a direction parallel to the centerline of the first aperture through the projections, a plurality of tabs that extend laterally out from the base to locate the shaving aid cartridge within packaging; and wherein no part of the base extends from the first surface to the contact surface between the solid erodable body and the first aperture; and wherein the soap-type material passes through and beyond the shaving aid material solidification apertures to define a continuous path around a portion of the projection to secure the solid erodable body to the base; and the first surface is spaced from the contact surface.

2. The shaving aid cartridge of claim 1, wherein the base further comprises one or more features for attaching the shaving aid cartridge to the razor assembly.

3. The shaving aid cartridge of claim 1, wherein the body is one piece.

4. The shaving aid cartridge of claim 3, wherein the body is oval shaped.

5. The shaving aid cartridge of claim 4, wherein the contact surface is skewed relative to a centerline of the first aperture.

6. The shaving aid cartridge of claim 1, wherein the body comprises a plurality of pieces.

7. The shaving aid cartridge of claim 6, wherein the plurality of body pieces form an oval shape surrounding the first aperture.

8. The shaving aid cartridge of claim 7, wherein the contact surface is skewed relative to a centerline of the first aperture.

9. The shaving aid cartridge of claim 6, wherein the plurality of body pieces include a forward portion and an aft portion.

* * * * *